United States Patent [19]

Schnarel

[11] Patent Number: 4,888,582

[45] Date of Patent: Dec. 19, 1989

[54] APPARATUS FOR STORING MULTI-BIT PIXEL DATA

[75] Inventor: Charles B. Schnarel, Aloha, Oreg.

[73] Assignee: Tektronix, Inc., Beaverton, Oreg.

[21] Appl. No.: 158,067

[22] Filed: Feb. 12, 1988

Related U.S. Application Data

[63] Continuation of Ser. No. 673,817, Nov. 24, 1984, abandoned.

[51] Int. Cl.[4] ..... G09G 1/16

[52] U.S. Cl. ..... 340/703; 340/799

[58] Field of Search ..... 340/701, 703, 798, 799, 340/723, 747

[56] References Cited

U.S. PATENT DOCUMENTS

| | | | |
|---|---|---|---|
| 4,236,228 | 11/1980 | Nagashima et al. | 340/799 |
| 4,291,306 | 9/1981 | Kodama et al. | 340/799 |
| 4,352,100 | 9/1982 | O'Connell | 340/798 |
| 4,562,435 | 12/1985 | McDonough et al. | 340/799 |
| 4,620,186 | 10/1986 | Krause et al. | 340/703 |
| 4,635,049 | 1/1987 | Dodge et al. | 340/703 |
| 4,688,031 | 8/1987 | Haggerty | 340/703 |

*Primary Examiner*—Gerald Brigance

*Attorney, Agent, or Firm*—Robert S. Hulse; Daniel J. Bedell

[57] ABSTRACT

An apparatus for storing multi-bit pixel data comprises a random access memory, for storing a plurality of pixels at each addressable memory location, the memory having one write enable and one data input for each bit of each pixel at a currently addressed memory location. Means are provided to couple each line of a data bus to the write enable inputs associated with corresponding bits of each addressed pixel and to place a common bit, in a selected state, on every data input assosciated with a corresponding bit of each currently addressed pixel, thereby permitting a processor to rewrite the addressed pixels with a selected pixel value, provided the write enables of each pixel are activated by an appropriate bit on the associated data bus line, and thereby permitting a processor to write pixel data to the memory using only one bit per pixel on the data bus. The apparatus also comprises means to generate a data word, each bit in said data word corresponding to one pixel at the currently addressed memory location, the state of each bit depending on whether the corresponding pixel state meets selected criteria, the data word being selectively applied to the data bus.

7 Claims, 2 Drawing Sheets

APPARATUS FOR STORING MULTI-BIT PIXEL DATA

This is a Continuation of application Ser. No. 673,817 filed Nov. 24, 1984 now abandoned.

BACKGROUND OF THE INVENTION

The present invention relates in general to digital circuits for control of cathode ray tube (CRT) displays and particularly to circuits for bit-mapping multi-bit pixel displays.

In a typical bit-mapped, black and white, CRT control system the CRT display is divided into a matrix of pixels and each pixel may be illuminated as necessary to create the desired image on the CRT screen. Each pixel corresponds to a specific bit of a word, stored at a specific address in a random access memory, the pixel being illuminated depending on whether the associated bit is high or low. In a memory having sixteen bit words, information regarding the state of up to sixteen pixels may be stored in each memory location.

In a bit-mapped, color display system, each pixel can take on any of several colors, usually including black and white, requiring more than one bit to describe the color state of each pixel. For instance, in a four bit mapping system, each pixel can be displayed in as many as 16 different colors because there are 16 possible combinations of the four bits describing the pixel. Two methods of storing multi-bit pixel data have been utilized. In a first method, the pixel bits are all stored in the same memory word such that, for instance, a sixteen bit word at a particular memory location may store the bits required to describe four four bit pixels. Thus a single read or write cycle can access or change four four-bit pixels as opposed to sixteen pixels in a single bit per pixel system.

In a second method, each bit of a multi-bit pixel is stored in a separate memory array (or memory "plane") such that in an n-bit per pixel system there are n "overlayed" memory arrays ("planes"), each identical to a single bit per pixel memory array. In this arrangement, assuming sixteen bit words and four bit pixels, the data for a single pixel is stored in four separate memory locations, and four read or write cycles are required to determine or change the color of any one pixel, although 16 pixels are accessed during the four cycles.

These multiple bit-mapped display methods generally involve slower display update times and require longer processing times than single bit per pixel display systems due to the increased number of bits per pixel which must be passed between a processor and a memory array and manipulated by the processor during logical operations. In using either method, it takes about four times longer to update a four bit per pixel display than to update a single bit per pixel display. The display is typically updated by successively writing the pixel data into each plane causing the screen to change several times during each update. The intermediate steps can make the update cycle appear longer to a viewer than when an update occurs in a single step, even if the single step update takes as long as a four step update. Also, whenever the state of any one pixel is to be changed, the controlling processor must ascertain the colors of any other pixels having data sharing the same word in memory. Therefore the processor must read the currently stored word before writing over it. The processor must also read all of the stored pixel data and perform a series of logical operations to determine which pixels are of a particular bit pattern, as for instance, when searching for pixels of a particular color in a bit-mapped color display.

SUMMARY OF THE INVENTION

According to one aspect of the invention, a four bit pixel display is bit-mapped onto a memory array having 64 bit words at each memory address and configured such that 16 four bit pixels are associated with each memory word, the array having one data input, one write enable input, and one data output for each bit of a currently addressed 64-bit memory word. In order to write to any bit in the memory array, the bit is placed on a corresponding data input line, a corresponding write enable input is energized by an associated write enable line, and finally, the memory array is strobed by a write signal from a selectively addressed memory controller.

According to another aspect of the invention, a data expansion mechanism is provided whereby each line in a sixteen bit data bus from a processor is linked in parallel to corresponding write enable inputs of the 16 four-bit pixels. Each output line of a four bit register, the "write" register, is connected in parallel to all 16 data input terminals associated with corresponding bits of each pixel of a currently addressed word. Thus, during a write cycle, the four bit data in the write register will be written to every pixel, at the current memory address, whose corresponding write enables have been energized by a bit on the data bus.

Where a four bit pixel code designates a color to be displayed on a cathode ray tube, the display may be updated one color at a time. The processor stores in the write register a four bit code, representing the selected color, and then places a sixteen bit word on the data bus with each high bit in the data word representing a pixel to be changed to the selected color, and with each low bit in the data word representing a pixel to remain unchanged. The appropriate memory address is then placed on the address bus and the memory is strobed, causing the four bit code in the write register to be written into the selected pixels at the selected address. Thus up to sixteen pixels may be written in a single write cycle, the processor using only one data bit to control the state of each pixel. Further, since a low bit on the data line causes a corresponding pixel to remain unchanged during a write strobe, it is not necessary for the processor to read and then rewrite the unchanged pixel data when changing the value of other pixels at the same memory address.

According to still another aspect of the invention, a data compression mechanism is provided whereby the 64 data output lines of the memory array are grouped into 16 sets of four lines, such that each line of a set carries one of the four bits of a given pixel. Each set of four data lines is applied to an associated evaluation circuit, which determines if the pixel value falls within limits set by the processor, and produces a single bit output indicating the results of the evaluation. The sixteen single bit outputs of the 16 evaluation circuits are transmitted to the processor over the sixteen bit data bus.

These aspects of the invention are particularly useful in conjunction with software using an overlay approach to color display control, wherein only one color at a time is processed and wherein the display is updated one color at a time. The invention permits memory read and write, and processing operations using only one bit per pixel, while retaining four bit color resolution, thereby permitting display updating and speeds approaching that of bit-mapped black and white display systems.

According to a further aspect of the invention the pixel bits may be masked prior to evaluation, thereby permitting the evaluation circuit to be configured to produce an output bit on occurrence of any set of pixel values. The write enables may also be masked such that selected bits of such pixel may not be overwritten regardless of the data on the data bus. This aspect of the invention is particularly useful in applications where the display can be thought of as comprising overlapping "surfaces", with each bit of a four bit pixel representing one "pixel" of one surface, for it allows the processor to quickly read and modify the display on a surface-by-surface basis.

According to a still further aspect of the invention, means are provided to permit the processor to read and write multi-bit pixel data directly, bypassing the compression and expansion mechanism when the processor requires access to multiple bit pixel information. The bypass mechanism breaks up the multiple bit pixel information as required to match the number of bits in the microprocessor bus.

It is accordingly an object of the present invention to provide a new and improved apparatus for storing multi-bit pixel data wherein the pixel data may be rapidly read and overwritten.

It is another object of the present invention to provide a new and improved apparatus for storing multi-bit pixel data having a data compression mechanism permitting a processor to work with only one bit per pixel-regardless of the number of bits per pixel stored in memory.

It is another object of the present invention to provide a new and improved apparatus for storing multi-bit pixel data having a data expansion mechanism permitting a processor to deposit a multi-bit pixel value in memory while passing only a single bit per pixel over the data bus.

It is a further object of the present invention to provide a means for bypassing the data expansion and compression mechanisms thereby permitting the processor to read and write data on a word-by-word basis.

It is a still further object of the present invention to provide a new and improved apparatus for storing multi-bit pixel data having means to produce an output bit whenever stored pixel data meet selected criteria.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

FIG. 1 is a block diagram of an apparatus according to the present invention, FIG. 2 is a block diagram showing the data evaluation circuit of FIG. 1 in more detail, FIG. 3 is a block diagram illustrating the masking circuit of FIG. 1 in more detail, and FIG. 4 illustrates a decoding circuit.

DETAILED DESCRIPTION

Figure 1:
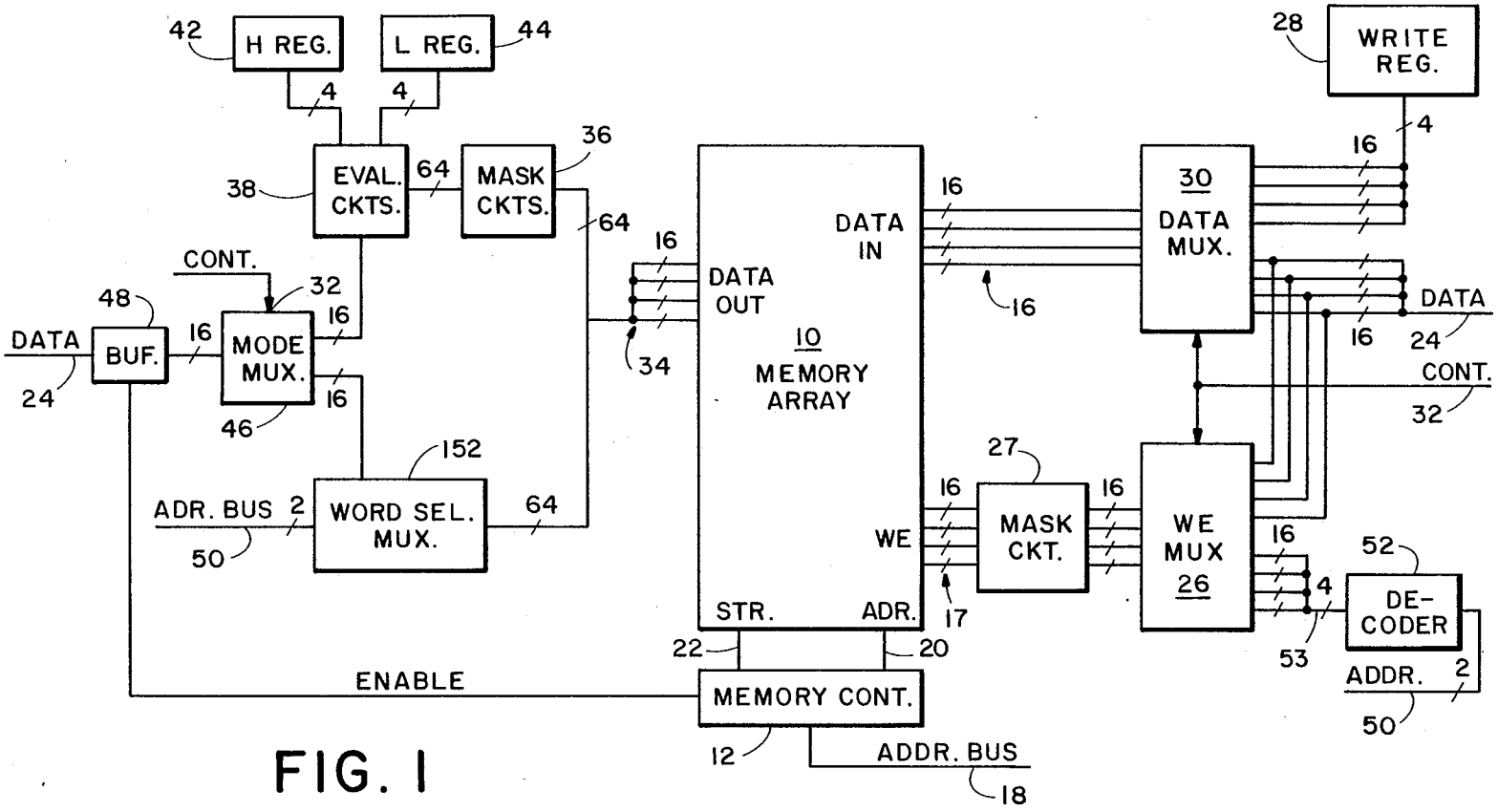

Referring to FIG. 1, an apparatus for storing multi-bit pixel data, illustrated in block diagram form, is adapted to store 16 four bit pixels in a 64 bit word at each memory location of memory array 10, the array having one data input, one write enable (WE) input, and one data output for each bit of a 64 bit memory word, currently addressed by memory controller 12. In order to write to any bit in memory array 10, the bit is placed on a corresponding data input line !6, a corresponding write enable input is energized by an associated write enable line 17, the memory address is placed on address bus 18, the appropriate addressing signals are placed on memory control lines 20 by memory controller 12, and finally, memory array 10 is strobed by a write signal from memory controller 12 via write strobe line 22.

The bit-mapping system of the present invention allows a processor (not shown) to read and write pixel data to memory array 10 in either of two modes: a "pixel" mode or a "data" mode. In the data mode, the processor may, during one read (or write) cycle, read (or write) four selected pixels from (or into) any addressed memory location. In the pixel mode, the processor may, during any one read cycle, determine which of the 16 pixels at any one memory address conform to selected bit patterns and may, during any one write cycle, write any selected pixel at a selected memory address to conform to a selected bit pattern.

To implement the write feature of the pixel mode, a data expansion mechanism is provided, whereby each line in a sixteen bit data bus 24 is linked in parallel to corresponding write enable inputs WE of memory array 10 through masking circuit 27 and through write enable multiplexer 26, when switched to a pixel mode state by a signal on mode control line 32. Masking circuit 27 is described in more detail hereinbelow. Each output line of a four bit, "write" register 28, is connected in parallel to corresponding data input terminals of the 16 currently addressed pixels by data input multiplexing means 30, when also switched to a pixel mode state by a signal on mode control line 32. (Control line 32 may comprise a portion of address lines 18 not otherwise used to address memory array 10.) Thus, during a pixel mode write cycle, the four data bits in write register 28 will be written to every pixel, at the current memory address, whose corresponding write enable input has been energized by a bit on the data bus 24.

Assuming that pixel data represents the color of a pixel, the display may be updated one color at a time. The processor stores, in write register 28, a four bit code representing the selected color, and then places a sixteen bit word on data bus 24 with each high bit in the data word representing a pixel to be changed to the selected color, and with each low bit in the data word representing a pixel to remain unchanged. The appropriate memory address is then placed on the address bus 18, and the memory is strobed by memory controller 12, causing the four bit code in write register 28 to replace the pixel data corresponding to the selected pixels at the selected address. Thus up to sixteen four bit pixels may be changed in a single write cycle, the processor using only one data bit to control the state of each pixel. Further, since a low bit on the data line causes a corresponding pixel to remain unchanged during a write strobe, it is not necessary for the processor to read and then rewrite the unchanged pixel data when changing the value of other pixels at the same memory address.

To implement the read feature of the pixel mode, a data compression mechanism is provided wherein the 64 data output lines 34 of the memory array are grouped into 16 sets of four lines, such that each line of a set carries one of the four bits of a pixel at the current memory address. Each set of four data lines is applied to an associated masking circuit 36 which may be configured to transmit the four bit data to an associated evaluation circuit 38. The purpose of masking circuit 36 is also described in more detail hereinbelow.

Each of the 16 evaluation circuits 38 determines if the value of the applied pixel data falls within limits set by the processor. The upper limit (designated by variable H) is stored in H limit register 42 while the lower limit (L) is stored in L limit register 44. Each evaluation circuit 38 produces a single bit output indicating the results of the evaluation. The sixteen single bit outputs of the 16 evaluation circuits are transmitted through mode multiplexer 46, when switched to the pixel mode by a signal on control line 32, to data buffer 48. Buffer 48 places the evaluation data on data bus 24 when enabled by memory controller 12 during a read cycle.

Figure 2:
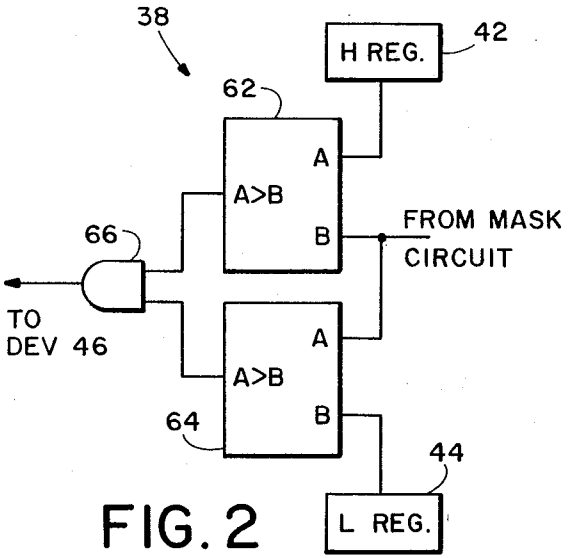

Evaluation circuit 38, depicted in more detail in FIG. 2, includes a pair of four bit comparators 62 and 64, each having four bit inputs A and B, and each producing a single bit output signal whenever the value of the A input exceeds the value of the B input. The data in H limit register 43 is applied to the A input of comparator 62 while the data in L limit register 44 is applied to the B input of register 64. The pixel data from masking circuit 36 is applied to the A input of comparator 64 and to the B input of comparator 62. The outputs of comparators 62 and 64 are summed by AND gate 66 to produce the compressed, single bit representation of the pixel, whenever the value of the applied pixel data lies between the values of the data stored in registers 42 and 44.

Figure 3:
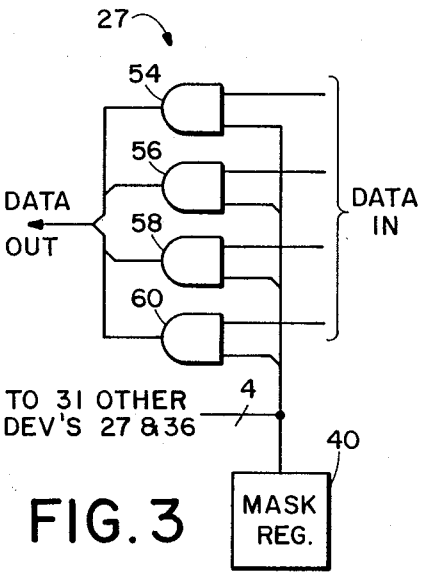

Masking circuits 27 and 36 are identical and are depicted in more detail in block diagram form in FIG. 3. Each masking circuit comprises 16 groups of four AND gates (54, 56, 58 and 60) with each group of AND gates corresponding to one pixel of a currently addressed 16 pixel word. One data bit associated with each bit of a pixel is applied to one input of each corresponding AND gate. Mask register 40 stores a four bit code, previously loaded therein by a controlling processor, and has one data output line associated with each of the four stored data bits. Each data output line of register 40 is connected in parallel to each AND gate of each group of four AND gates in each of the 16 masking circuits 27 and to one AND gate of each group of four AND gates in each of the 16 masking circuits 36. If each of the four bits in register 40 is in logical state "1", then the data outputs of AND gates 54, 56, 58 and 60 are equal to their corresponding pixel data inputs. If any one of the bits stored in register 40 is a logical "0", then the output of the corresponding AND gate is a 0 regardless of the corresponding pixel data input.

By selectively loading 0's into one or more of the four bit storage cells of mask register 40, with 1's loaded into the remaining bits, corresponding bits of each currently addressed pixel (i.e., pixel bits corresponding to the zero bits of the mask register) may be "masked" such that these bits remain unchanged during a memory write operation, regardless of the data on data bus 24 because corresponding write enable inputs are deactivated. Similarly, by selectively loading 0's into one or more of the four cells of register 40, corresponding bits of each currently addressed pixel may be masked during a read operation such that these bits are passed to evaluation circuit 38 as 0's regardless of the state of the associated pixel bit data received by masking circuit 36 from memory array 10 during a read cycle.

Assuming, by way of example, that the pixel data corresponds to the color of each pixel, and that the processor wishes to determine which pixels are of colors lying within a particular color range, the processor loads appropriate masking data into register 40 and appropriate limiting data into registers 42 and 44, such that each evaluation circuit 38 produces a high output data bit whenever the associated pixel color lies within the selected range. The pixel mode of memory access thus alleviates the need for the processor to perform logical operations on the pixel data to determine the color of the pixels, and allows the processor to manipulate the display using only one bit per pixel.

Assuming, by way of a second example, that the display is configured as a set of overlapping "surfaces" with each surface single bit-mapped onto one of four memory "planes" with each plane comprising a pixel of each 64 bit memory word, and that the processor wishes to determine which pixels contain bits illuminating a point on a particular surface, or set of surfaces, the processor may configure the data stored in registers 40, 42 and 44 such that each evaluation circuit 38 produces a high output data bit whenever the associated pixel contains a high (or low) bit (or bits) in the memory plane (or Planes) of interest. The masking circuits alleviate the need for the processor to perform logical operations on the pixel data to determine the state of a particular display surface, and allows the processor to manipulate data regarding each surface using only one bit per pixel.

In the data mode, the data compression and expansion mechanisms used in the pixel mode are bypassed and the processor writes and reads data in and out of memory array 10 in a word-by-word fashion. During a data mode write cycle, data input multiplexing circuit 30 is switched by control line 32 to a data mode state to connect each line of data bus 24 in parallel to four corresponding data input lines 16 to memory array 10. When switched to the data mode by control line 32, write enable multiplexing circuit 26 controls the 64 write enable inputs of memory array 10 such that all of the write enable inputs of a selected sub-group of four pixels in a currently addressed group of 16 pixels are activated, while the write enable inputs of the other 12 pixels are deactivated.

Figure 4:
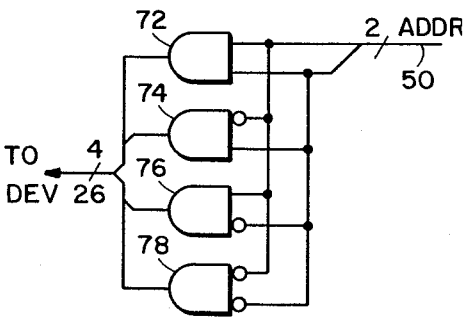

The subgroup to be write enabled is selected by an appropriate two bit code on control bus 50, which may be a part of address bus 18 not otherwise used to address memory array 10. Control bus 50 is applied to decoding circuit 52 which produces an output signal on one of four output lines 53 depending on which of the four possible input signal combinations appear on the two lines of control line 50. Decoding circuit 52, shown in more detail in FIG. 4, comprises a set of four AND gates, 72, 74, 76 and 78, with the two lines of control bus 50 being applied in parallel to the two inputs of each AND gate. Opposite inputs of AND gates 74 and 76 are inverted, both inputs of AND gate 78 are inverted, and neither input of AND gate 72 is inverted. The output of each AND gate is placed in a high state by a unique combination of states on the lines of control bus 50 and comprise the four outputs of decoding circuit, each AND gate output being applied in parallel to 16 inputs of write enable multiplexer 24.

To write to the selected group of four pixels while in the data mode, the appropriate masking code is placed in masking register 40 of mask circuit 27, the 16 bit data is placed on data bus 24, the appropriate data mode bit is placed on control line 32 (to switch circuits 26 and 30 to the data mode), and array 10 is write strobed via write strobe line 22 with the correct address on address bus 18.

During a data mode read cycle, word selecting multiplexer circuit 152 transmits one selected 16 bit word, of the four 16 bit data words appearing on the 64 data output lines 34, to data output multiplexing circuit 46, with the selection being controlled by data appearing on lines 50 from the microprocessor. With multiplexer 46 switched to the data mode by control line 32, the selected data word from circuit 152 is passed to buffer 48, for placing the selected word on data bus 24 when enabled by memory control circuit 12.

While a preferred embodiment of the present invention has been shown and described, it will be apparent to those skilled in the art that many changes and modifications may be made without departing from the invention in its broader aspects. For instance, while the preferred embodiment has employed a four bit per pixel, sixteen pixel memory word array, mapping a four bit per pixel display, memory arrays of other dimensions may be utilized to bit map, in a similar fashion, displays having other numbers of bits per pixel. Also numerous implementations of the various component circuits are known in the art. The appended claims are therefore intended to cover all such changes and modifications as fall within the true spirit and scope of the invention.

I claim:

1. An apparatus for storing multi-bit pixel data comprising:

a random access memory, a plurality of pixels being stored at each addressable memory location, said memory having one write enable input and one data input corresponding to each bit of each pixel at a currently addressed memory location, a data bus, means to selectively couple every line of the data bus either to a write enable input, associated with corresponding bits of every pixel at the currently addressed memory location, or to a data input, associated with corresponding bits of every pixel at the currently addressed memory location, register means for storing at least one bit for each pixel having a separate register data output line associated with each register bit, and means to selectively couple the data inputs associated with corresponding bits of every pixel at the currently addressed memory location to either one register data output line or to one data bus line.

2. An apparatus comprising:

a memory for storing sets of multi-bit pixel color data at addressable locations; and means coupled to access the memory for changing selected sets of the multi-bit pixel color data to single-bit data, thereby compressing the selected multi-bit data, each selected set of the multi-bit data being changed to a single-bit data of one or zero, according to the selected data being within or outside predetermined numerical limits.

3. An apparatus as in claim 2 wherein said means includes:

a pair of registers for storing the predetermined numerical limits as color values, and means for comparing each selected set of multi-bit color data to the predetermined numerical limits and producing a single-bit data value.

4. An apparatus as in claim 3 further including a means for selecting multi-bit data for changing according to predetermined masking criteria.

5. An apparatus comprising:

a memory for storing sets of multi-bit data at addressable locations, each multi-bit set representing the color of a pixel; and means coupled to the memory and responsive to applied single-bit data for changing selected sets of the stored data, corresponding to selected bits of the single-bit data, to sets of predetermined multi-bit color values, according to the selected bits being one or zero, thereby expanding selected single-bit data to predetermined multi-bit color values; selected stored data are changed when the corresponding selected bit is a first value, and not changed when it is a second value.

6. The apparatus of claim 5 wherein said means includes a register for storing the predetermined multi-bit data.

7. The apparatus of claim 6 wherein said means further includes a write enable means responsive to the single-bit data for addressing selected memory locations, and a making means for masking selected bits of the changed multi-bit color data for storage at the selected memory locations.

* * * * *